United States Patent [19]

Sato

[11] 4,087,057

[45] May 2, 1978

[54] SUPPORTING DEVICE FOR A ROLLED STRIP OF LABELS, OR THE LIKE

[75] Inventor: Yo Sato, Tokyo, Japan

[73] Assignee: Kabushiki Kaisha Sato Kenkyusho, Tokyo, Japan

[21] Appl. No.: 737,288

[22] Filed: Nov. 1, 1976

[30] Foreign Application Priority Data

| | | |
|---|---|---|
| Nov. 4, 1975 | Japan | 50-131438 |
| Feb. 12, 1976 | Japan | 51-013266 |

[51] Int. Cl.[2] ..... B65H 17/02

[52] U.S. Cl. ..... 242/68.3

[58] Field of Search ..... 242/68.3, 68.2, 72.1, 242/72; 403/422, 425

[56] References Cited

U.S. PATENT DOCUMENTS

| | | | |
|---|---|---|---|
| 2,983,460 | 5/1961 | Wright | 242/68.3 |
| 3,124,319 | 3/1964 | Cohen | 242/72.1 |
| 3,833,181 | 9/1974 | Watkins | 242/68.3 |
| 3,840,193 | 10/1974 | Feichtinger | 242/68.3 |

*Primary Examiner*—Edward J. McCarthy

*Attorney, Agent, or Firm*—Ostrolenk, Faber, Gerb & Soffen

[57] ABSTRACT

A supporting device for detachably supporting the core of a rolled label strip on a label printing and applying machine comprising a main body rotatably attached to the label printing and applying machine, a pushing member fitted on the main body and having pushing faces engageable with raised surfaces on the end of the core, fastening members pivotably attached to the main body and provided at one side with fastening sections which engage the end portion of the core and provided at the other side with disengaging means to be operated to pivot the fastening members to disengage from the core; a spring between the main body and the pushing member normally biases the pushing member to push away the core; and the fastening members hold the core in place.

37 Claims, 18 Drawing Figures

SUPPORTING DEVICE FOR A ROLLED STRIP OF LABELS, OR THE LIKE

BACKGROUND OF THE INVENTION

This invention relates to a supporting device for detachably supporting the core of a rolled label strip on a label printing and applying machine.

A widely used supporting device for a rolled label strip is comprised of a pair of flexible supporting plates that are arranged to define a U-shape as viewed from above the machine. Each plate is provided with a round projection on the inside facing walls of the U. To attach a rolled label strip to this labeling machine, the inner bore of the core of a rolled label strip is fitted to the projections on the walls. In this supporting device, the supporting plates are bent open in every attaching and detaching of the core. As a result, the supporting plates are liable to be deformed or damaged after repeated uses, and the rolled label strips will thereafter not be supported firmly.

Known label strip supports are described in "Core Supporting Device for Label Strip in Label Printing and Applying Machine," Japanese Patent Application No. 10960 of 1975 and "Supporting Device for Label Strip," Japanese Utility Model Application No. 48862 of 1975 both of which applications were filed by the assignees hereof.

In the supporting device disclosed in the above applications, the inner bore of the label strip is detachably supported by flexible supporting pieces projecting from the labeling machine. The supporting pieces have tabs on them. There are core supporting rotary members on the flexible supporting pieces and these pieces are pivoted to the side arm plates formed above the label printing and applying machine. When the label strip rolled on the core is pulled out, proper tension is always imparted to the core to inhibit its rotation.

However, in use, it has been found that a supporting device provided with the flexible supporting pieces having tabs have a number of disadvantages:

(1) The supporting pieces having tabs must be of short length due to their structures. Thus, they can have only slight flexibility, and the core must be fitted on them with strong pressure.

(2) When the core is disengaged from the supporting pieces after the label strip has been used up, the core must be forcibly disengaged by twisting it. It is difficult for the operator to know precisely how much force to apply. In addition, the supporting pieces are often damaged.

(3) After many cores have been used, the supporting pieces lose their flexibility and the supporting force becomes weak. This may result in undesired disengagement of the core during use of the labeling machine.

SUMMARY OF THE INVENTION

According to the present invention, there are fastening members which are formed separately from the main body of the core supporting device. The fastening members include fastening sections which are urged by biasing means to engage a core placed on the fastening members. Operation of the fastening members causes engagement or disengagement between the fastening sections and a fitting portion of the rolled label strip, i.e. on the core.

Therefore, the primary object of the present invention is to provide a supporting device for a rolled label strip so that the core can be engaged and disengaged easily, rapidly, firmly and reliably.

Another object of the present invention is to provide a supporting device for a rolled label strip which does not unexpectedly release the supported rolled label strip during use of the labeling machine.

A further object of the present invention is to provide a supporting device for a rolled label strip which avoids undesirable idle rotation of the rolled label strip.

In accordance with the present invention, the supporting device for a rolled label strip comprises: a main body rotatably attached to a portion of a label printing and applying machine, a pushing member having core pushing faces engageable with the end edge of the core of a rolled label strip, elastic pushing elements or biasing means disposed between the pushing member and the main body for pushing the pushing member against the core, fastening members each having a core fastening section at one end and a fastening member operating element at the other end thereof and being pivotally attached to the main body, an elastic element always urging the fastening sections of the fastening members to engage the core and the operating elements of the fastening members being operable to disengage the core. When the core is attached on the fastening members, the main body and the pushing member move close to each other and the fastening sections of the fastening members engage the fitting portion at the near end of the core. When the core is released, the fitting portion of the core is disengaged from the fastening sections of the fastening members, the main body and the pushing member move apart from each other and the core is moved away from the main body.

BRIEF DESCRIPTION OF THE DRAWINGS

These and other objects and features of the invention will become apparent from the following description taken in connection with the accompanying drawings in which.

DETAILED DESCRIPTION OF THE PREFERRED EMBODIMENTS

The accompanying drawings show preferred embodiments of the present invention. The first embodiment is now described.

Figure 5:
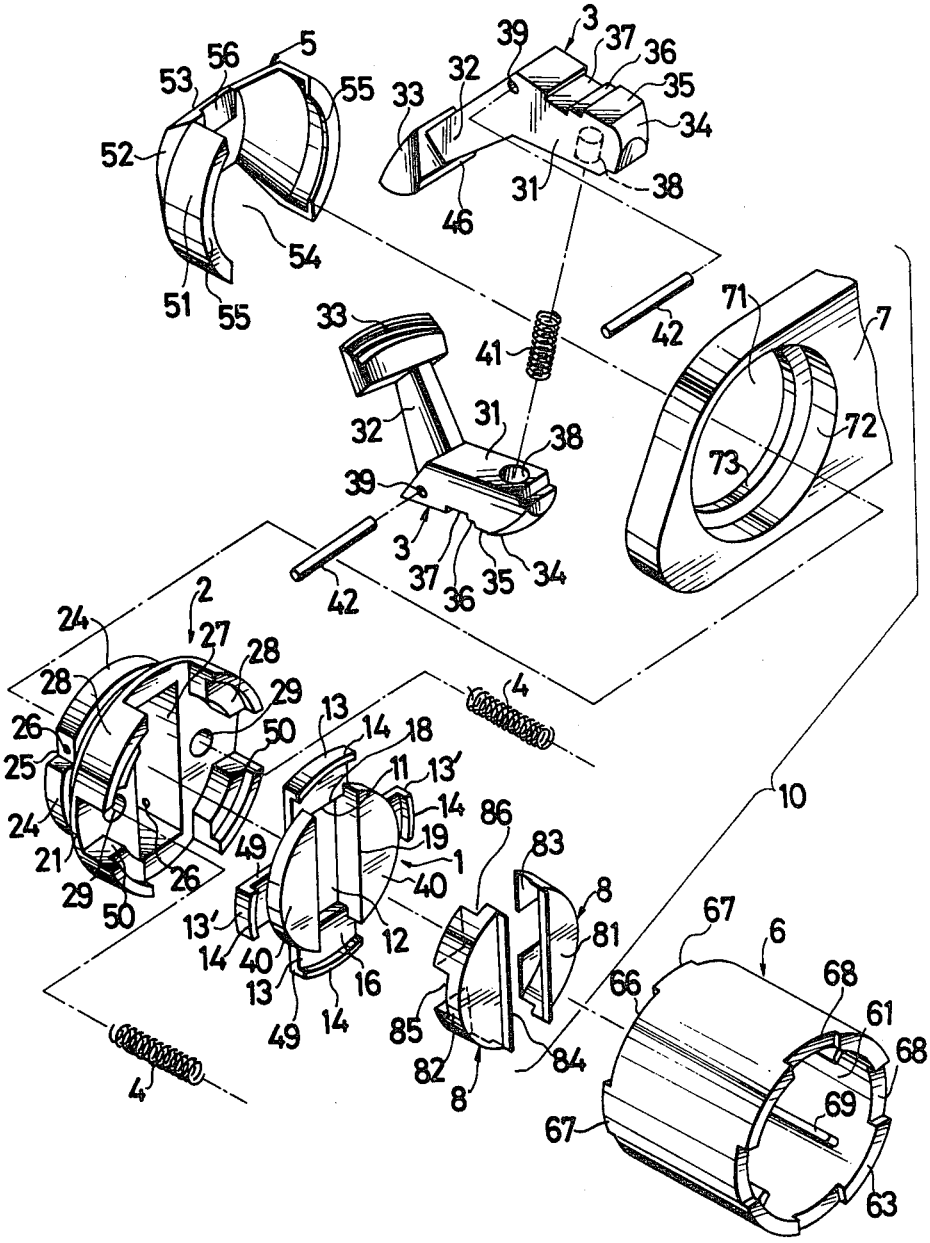
FIG. 5 is an exploded perspective assembly view of the first embodiment of the supporting device and the core.

As shown in FIG. 5, the supporting device 10 of the first embodiment of the present invention comprises a pushing member 1, a main body 2, core fastening members 3, pushing springs 4, a rear cover 5, a fastening member spring 41 and front covers 8.

The pushing member 1 is located inside the supporting device 10 at the side thereof to which a core 6 of a rolled label strip is attached. The pushing member 1 includes two partial circle periphery, solid disks 40 of a size of nearly a semicircle. The inside opposed surfaces of disks 40 are shaped to define a rectangular opening 12. A first pair of pushing lugs 13 are integrally attached to disks 40 above both of the short side walls 11 which define the opening 12. Each of a second pair of pushing lugs 13′ is integrally attached to project beyond a respective disk 40. Lugs 13′ are disposed outside the long side walls 19 which also define the opening 12.

Figure 6B:
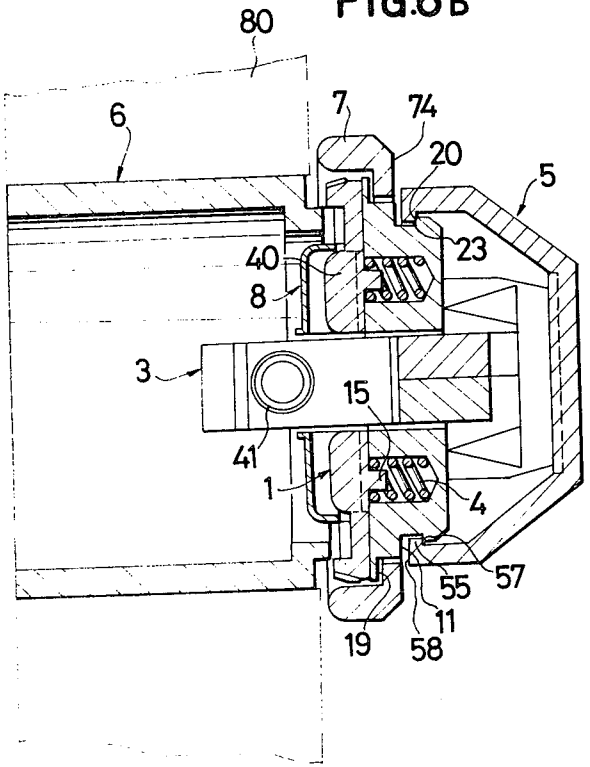
FIGS. 6(*a*) and 6(*b*) are cross-sectional views taken along the line VI—VI in FIG. 1, in which FIG. 6(*a*) shows the condition before the core is attached to the supporting device and FIG. 6(*b*) shows the condition after the core is attached.
Figure 6A:
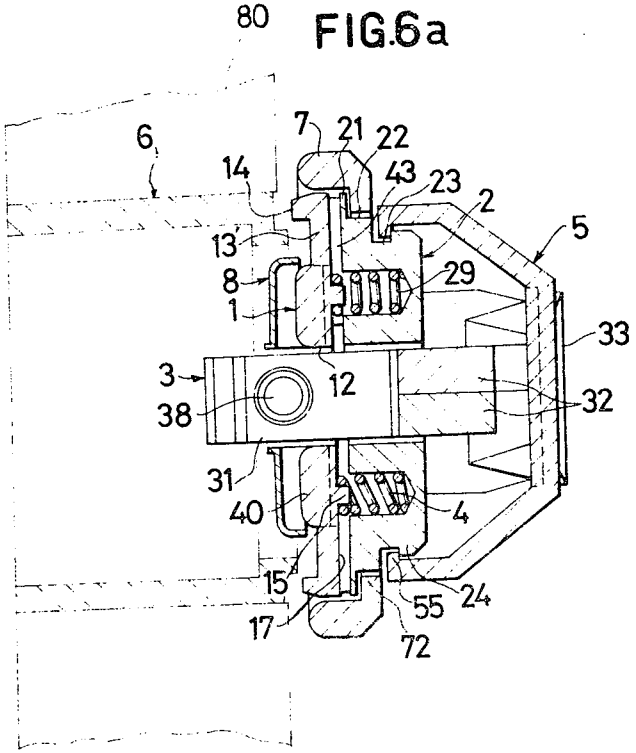

The pushing lugs 13 and 13′ all have outer arcuately curved outer rims which are aligned on the same circumference. The outer edge portions of the rims are bent at right angles with respect to the lugs and toward the core 6. These edges of the lugs face toward the core 6 and define respective core pushing faces 14. Further, as shown in FIGS. 6(*a*) and 6(*b*), projections 15 for receiving a pair of pushing springs 4 are formed at the radially inward portions of the rearward surfaces 17 of the lugs 13′, i.e. the surfaces opposite to the pushing faces 14. The projections 15 are positioned on opposite lugs 13′ with the opening 12 between them.

The main body 2 includes an annular collar 21 having the same diameter as the outer rims of pushing lugs 13 and 13′ of the pushing member 1. The main body 2 includes the following elements on the side of body 2 away from core 6 and extending toward rear cover 5: an annular stepped portion 22 positioned further from the core 6 than collar 21 and having a smaller diameter than collar 21, a circular groove 23 still further from core 6 and having a smaller diameter than the stepped portion 22, and an annular rim 24 even further from core 6 and having a slightly larger diameter than the circular groove 23. Further, the rim 24 has four V-shaped notches 25 formed at the quarter points around its periphery. A rectangular attachment hole 27 is formed in the middle portion of the main body 2 and is alignable with opening 12 through pushing member 1.

Fulcrum pin holes 26 extend through the main body 2 between the large internal attachment hole 27 and each of the notches 25 in the rim 24. As partly shown in FIG. 5, there are four holes 26 which extend horizontally and left and right from the upper and lower portions of the left and right inside surfaces of the attachment hole 27 toward the left and right sides of the main body 2.

In each quadrant around the collar 21 and on the side of the collar facing toward the core 6, four fan or crescent shaped guide members 28 are formed. These have L-shaped cross-sections viewed in a plane along body 2. The forwardly projecting leg 28*a* of each guide member 28 is receivable in a correspondingly shaped recess 66 in below described core 6. At both annular ends of each of the guide members 28 is formed a respective radially extending guide surface 50. The guide members 28 and their guide surfaces 50 and the pushing lugs 13, 13′ and their side surfaces 49 are so shaped and sized that the side surfaces 49 are closely fitted to and guided by and between the guide surfaces 50.

A pair of blind holes 29 are formed on the side of the main body 2 that is opposed to the rearward surface 17 of the pushing body 1. Holes 29 are located at positions coinciding with the positions of the supporting projections 15 on lugs 13′ so that pushing springs 4 might extend between them. Thus, when the pushing member 1 and the main body 2 are assembled, each pushing spring 4 is received by a respective supporting projection 15 and blind hole 29.

Each of the two fastening members 3 is generally L-shaped. One end portion of a member 3 is its fastening section 31 and the other end portion is its disengaging pinch piece 33 which is joined to section 31 by an arm 32. The outer side of the fastening section 31 includes, in sequence moving away from the forward end of member 3 and each shorter in height than the previous feature, an inclined slip head 34, followed by a fastening step 35 engageable with the rolled strip, i.e. with the inner bore of the core 6, a disengaging step 36 engageable with the side walls 11 of the opening 12 when the core is not fastened and an attaching groove 37 also engageable with the side walls 11 of the opening 12, but when the core is fastened. Further, on the side of each fastening section 31 facing toward the other fastening section 31 and at the forward end of each section 31, a blind hole 38 is formed which is positioned opposite the blind hole 38 that is formed on the other fastening section 31. At the bend of the fastening member 3 there is a fulcrum pin receiving hole 39 having about the same diameter as the fulcrum pin hole 26 in the main body 2.

Each arm 32 of the fastening members 3 is positioned slightly off the center line between the fastening section 31 and the disengaging pinch piece 33 of its member 3. When the pair of fastening members 3 are assembled with the inside surfaces of the fastening sections 31 opposed to one another, the arms 32 intersect and extend past each other. The spring 41 is fitted into the blind holes 38 when the fastening sections 31 are assembled as described.

The rear cover 5 is comprised of a cylindrical front portion 51, a frustoconical rear portion 52 and a top or rearward face 53. The diametrically opposite portions of the cylindrical portion 51 and the frustoconical portion 52 are respectively cut away to form rearwardly extending arm 32 receiving and guiding openings 54. The forward end portion of the cylindrical portion 51 is bent radially inwardly at right angles to the cylindrical portion to form rims 55.

The front covers 8 extend over and are correspondingly shaped to the disks 40 of the pushing member 1. Each cover 8 integrally comprises a partial circle shaped front plate 81, a circumferential side plate 82 bent rearwardly from and extending along the rounded edge of the front plate 81, a rear plate 83 bent inwardly from the side plate 82 and opposed to the front plate 81, and an upright forwardly projecting plate 84 formed on the inner straight edge of the upper plate 81. Midway around and at both rear end portions of the side plates 82 and also at the rear plates 83, horizontal cutaway portions 85 are formed. At the top and bottom ends of side plates 82 and rear plates 85 vertical cutaway portions 86 are formed. Cutaway portions 85 and 86 extend from the middle of the axial width of the side plates 82 to and through the rear plates 83. The widths in the axial direction of the side plates 82 is made larger than the axial thicknesses of the circular disks 40 of the pushing member 1. This allows the pushing member 1 to move across the space between the front plates 81 and the rear plates 83 when these elements are assembled.

The above disclosed parts are assembled in the manner shown in FIGS. 3, 4, 6 and 7. This assembly of parts is attached to the side arm plate 7 which is formed on the upper wall of a labeling machine. During assembly, the pushing lugs 13' of the pushing member 1 are emplaced in and extend completely through the cutaway portions 85 of the covers 8 to the outside so that the pushing member 1 fits into the front covers 8. The inwardly facing surfaces of the side plates 82 contact the curved side edge surfaces of the rounded disks 40 of the pushing member 1.

Next, the pushing member 1, now carrying the front covers 8, is assembled with the main body 2 such that the side surfaces 49 of the four pushing lugs 13 and 13' are fitted into the four spaces, each formed between facing guide surfaces 50, of the guide members 28 of the main body 2. The rear plates 83 of the front covers 8 are thereby brought into contact with the forward face of the main body 2.

The pushing springs 4 have been previously emplaced between the blind holes 29 and the supporting projections 15.

This assembly is then fitted into the rotation hole 71 of the labeling machine side arm plate 7 from the right side in FIG. 5. The rotation hole 71 is defined by a two-stepped annular wall having a larger diameter portion 72 at the forward side toward the pushing member 1 and core 6 and a smaller diameter portion 73 at the rear side. The smaller diameter portion 73 is sized so that the stepped portion 22 of the main body 2 is fitted to it. The larger diameter portion 72 is sized so that the collar 21 and the guide members 28 of the main body 2 and the pushing lugs 13 and 13' of the pushing body 1 are fitted to it. The fitting together of these elements is such that rotary movement of the supporting member 10 is allowed while there is a desired degree of frictional resistance to pulling of the label strip 70.

Figure 7B:
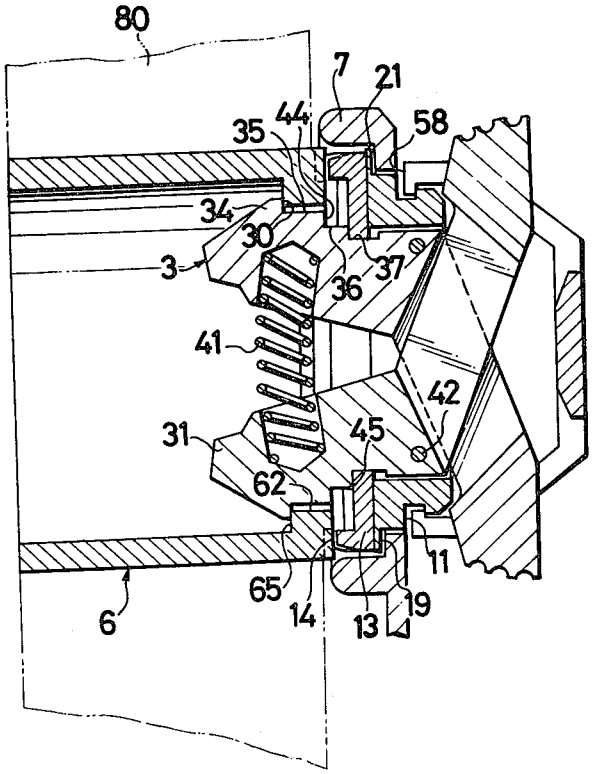
FIGS. 7(*a*) and 7(*b*) are cross-sectional views, taken along the line VII—VII in FIG. 1, in which FIG. 7(*a*) shows the condition before the core is attached to the supporting device and FIG. 7(*b*) shows the condition after the core is attached.
Figure 7A:
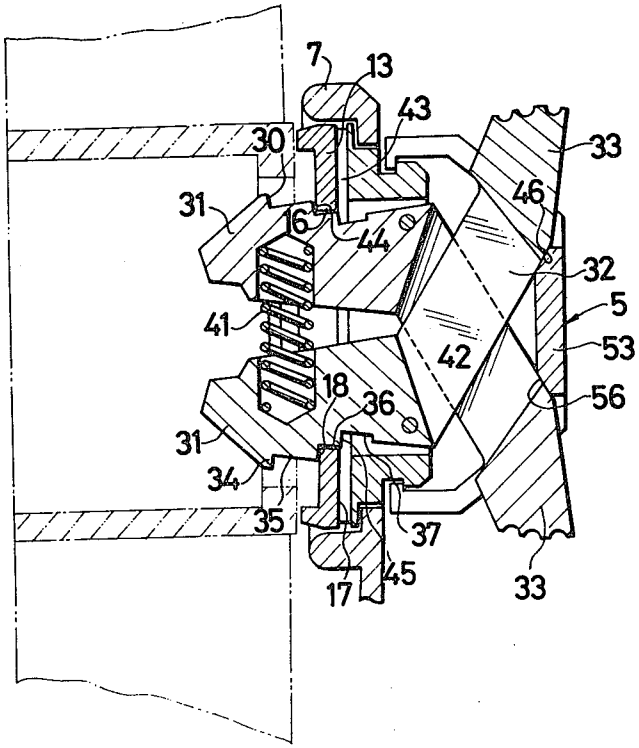

Next, the fastening spring 41 is fitted into the blind holes 38 of the fastening members 3 and the inside or facing surfaces of the fastening sections 31 are moved closer together. The fastening members 3 are then inserted into the attachment hole 27 in the main body 2 from the rear side. The forward tip ends of the fastening sections 31 are positioned in the rectangular opening 12 of the pushing member 1. As shown in FIG. 7(*a*), the disengaging steps 36 of the fastening sections 31 are brought into contact with the inside portions 16 of the shorter side walls 11 defining the rectangular hole 12 in the pushing member 1.

The fulcrum pin hole 39 of the upper fastening member 3 in FIG. 5 is aligned with the pair of pin holes 26 extending into the notches 25 of the uppermost rim portion 24 of the main body 2. The fulcrum pin hole 39 of the lower fastening member 3 is aligned with the other pair of pin holes 26 extending into the notches 25 of the lowermost rim portion 24 of the main body 2. Then the fulcrum pins 42 are inserted into the aligned pin holes to position the fastening members 3.

Figure 4:
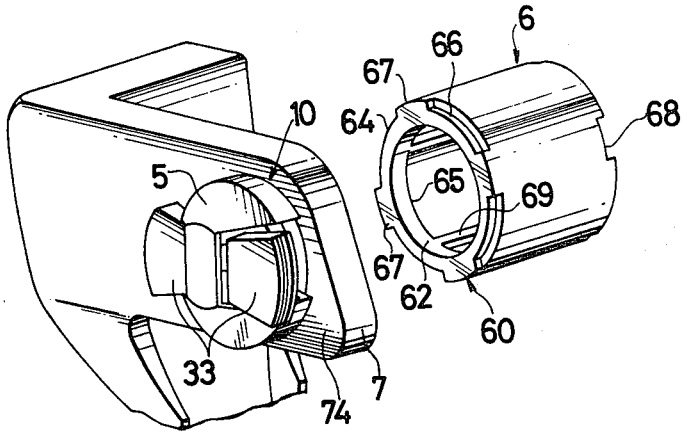
FIG. 4 is the opposite perspective view of the supporting device of the first embodiment of the present invention as viewed from the direction opposite to FIG. 3.

As shown in FIG. 4, the rear cover 5 is located at the disengaging pinch pieces 33 of the fastening members 3. The pinch pieces 33 project through the openings 54 in the cover. The rims 55 of the rear cover 5 are fitted into the circular groove 23 of the main body 2. As shown in FIG. 6(*b*), the inner, rearwardly facing fitting surfaces 57 of the rims 55 are brought into contact with the rear fitting surface 20 of the circular groove 23 of main body 2 with some pressure. A slight clearance is left between the forwardly facing surfaces 58 of the rims 55 and the outer surface 74 of the side arm plate 7 so as to allow rotation of the supporting device 10.

Figure 3:
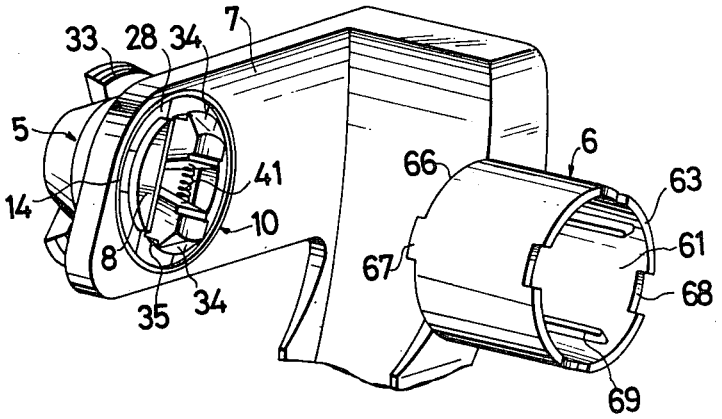
FIG. 3 is one perspective view of the first embodiment of the supporting device of the present invention as it appears when it is attached to a labeling machine.

A core 6 supporting a rolled label strip 70 is attached to the supporting device 10 of the present invention, which is rotatably secured to the side arm plate 7. The structure of the core 6 is shown in FIGS. 3 to 5. The cylindrical core 6 has one circular end face 63 and has an opposite circular end face 64, which is wider than the end face 63. The core has a fastening section 60 that is formed at the end face 64, a fitting surface 65 behind the end face 64 and inside the core and a short inner bore 62 extending between the end face 64 and the fitting surface 65. The core body extends from surface 65 to end face 63. The diameter of the bore 62 is smaller than the inner diameter of the remainder of the cylindrical body of the core 6 and the bore 62 is concentric with the cylindrical body.

Around the outer periphery of the end face 64, there are crescent or fan shaped recesses 66 for preventing idle rotation of the core. The recesses 66 are formed in opposite pairs. When the core 6 is secured in position by the fastening members 3, the legs 28*a* of members 28 are received in recesses 66, thereby ensuring that core 6 rotates with main body 2. The sections of end face 64 between the recesses 66 form raised surfaces 67. On the other end face 63 of core 6 are defined other identically sized and aligned recesses 68. Furthermore, the inner surface 61 of the core 6 is integrally provided with a plurality of supporting ribs 69 which extend parallel to the axis of the cylindrical body. The inner raised surfaces of ribs 69 are on the same inner diameter as the inner surface of the bore 62. Further details of label strip core construction can be obtained from U.S. application Ser. No. 650,622, filed Jan. 20, 1976, entitled "Core for Label Strip," now U.S. Pat. No. 3,997,125.

When the core 6 of the present invention is attached to the supporting device 10, as shown in FIGS. 6(*a*) and 7(*a*), four raised surfaces 67 of the core 6 are brought into contact with the respective ones of the four core pushing faces 14 of the pushing member 1 in the supporting device 10. The core 6 is then pushed toward the side arm plate 7. The pushing member 1 is thus moved toward the main body 2 pressing the pushing springs 4 and reducing the gap 43 that is held open by the force of the springs 4.

As shown in FIG. 7(*a*), before the pushing of the core 6, the right or forward end (as viewed in the drawing) of the disengaging step 36 of the fastening members 3 and the right or rearward end of the inner shorter side 16 of the rectangular opening 12 are in contact and the bearing surface 44 of the disengaging step 36 and the left corner 18 of the inner shorter side 16 are also in contact. Thus, the pushing member 1 is supported by the fastening members 3.

After pushing with the core 6, as shown in FIGS. 6(*b*) and 7(*b*), the above noted engagement is terminated and the fastening sections 31 of the fastening members 3 are pivoted slightly apart about the fulcrum pins 42 by the force of the fastening spring 41. At the same time, the inner shorter sides 16 of the rectangular opening 12 are received within the attaching grooves 37 of the fastening members 3 and are held by the bottom surfaces of the grooves 37. Further, the distance between the fastening steps 35 of the members 3 is enlarged. As a result, the fitting surface 65 of the core 6 is caught by the fitting surfaces 30 of the slip heads 34 of the fastening members 31. In addition, the pushing surfaces 14 of member 1 press against the raised surfaces 67 of the core 6, and thereby firmly and reliably support the core of a rolled label strip.

Because the disks 40 of the pushing member 1 have the front covers 8 positioned over them, the spacing between the fastening sections 31 of the fastening members 3 cannot be widened by accidental pushing upon the disks 40 when the core 6 is not attached, which would undesirably make the attaching of the core 6 difficult. The covers 8 block contact with disks 40.

Figure 1:
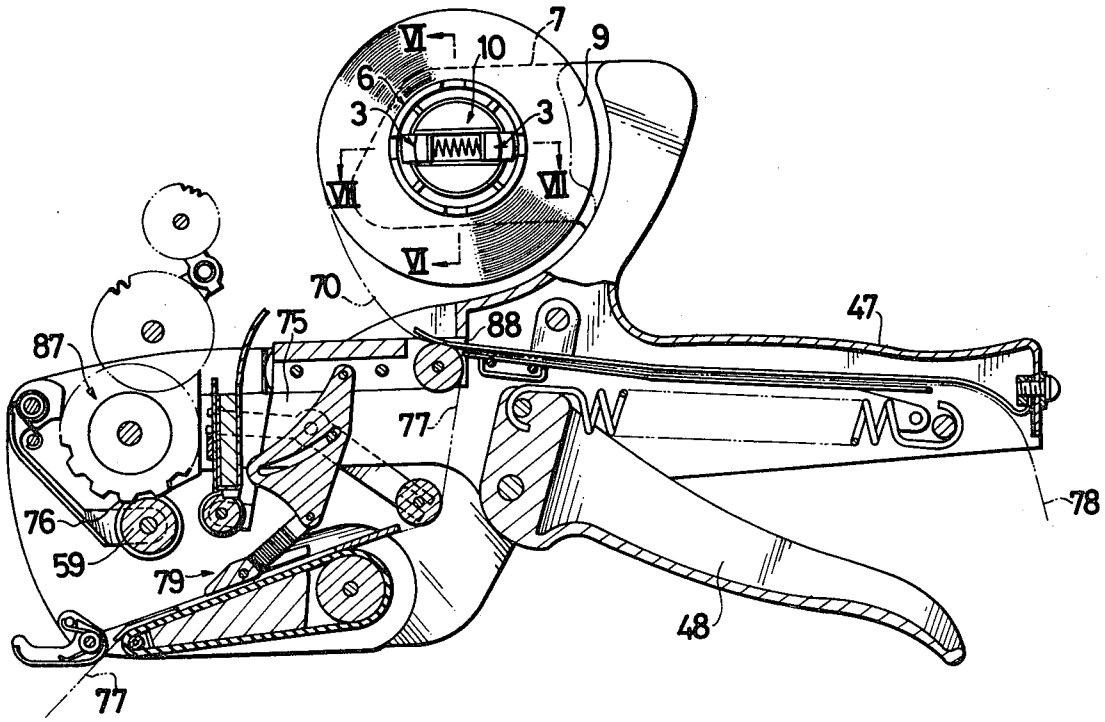
FIG. 1 is a vertical cross-sectional view of a label printing and applying machine which has been provided with a first embodiment of the supporting device of the present invention and viewed along the line of and in the direction of arrows 1—1 in FIG. 2.

Referring to FIG. 1, there is a label strip 70, which is divided into a continuous strip of individual labels 77 and a carrier strip 78. A labeling machine in which the invention may be used is described, for example, in U.S. application Ser. No. 673,380, filed Apr. 5, 1976, entitled "Portable Tagging Machine;" and 686,562, filed May 14, 1976, entitled "Label Feed Mechanism for Portable Labeling Machines." When the hand lever 48 of the label printing and applying machine is squeezed toward the grip 47, the hand lever 48 is pivoted upwardly. There is a yoke 75 that is attached to and extends forward of and is movable with lever 48. There is a printing device 87 on the yoke 75 which is moved downward to print upon the surface of a label 77 when lever 48 pivots up. The type face 76 of the printing device 87 has ink applied to it by an inking roller 59 as the roller 59 is pushed aside by the descending printing device 87.

When the hand lever 48 is released, the printing device 87 is raised together with the yoke 75. The label 77 and the label strip 70 are advanced (to the left in FIG. 1) by the label strip advancing mechanism 79. With this movement of the label 77 and of label strip 70, label strip 70 is pulled forth, whereby the rolled label strip 80, its core 6 and the supporting device 10 are simultaneously turned. The label strip 70 is fed into a peeling section 88 at which the labels 77 are separated from the carrier strip 78. Just beyond the peeling section is an applicator for applying the separated labels to objects to be labeled.

Figure 2:
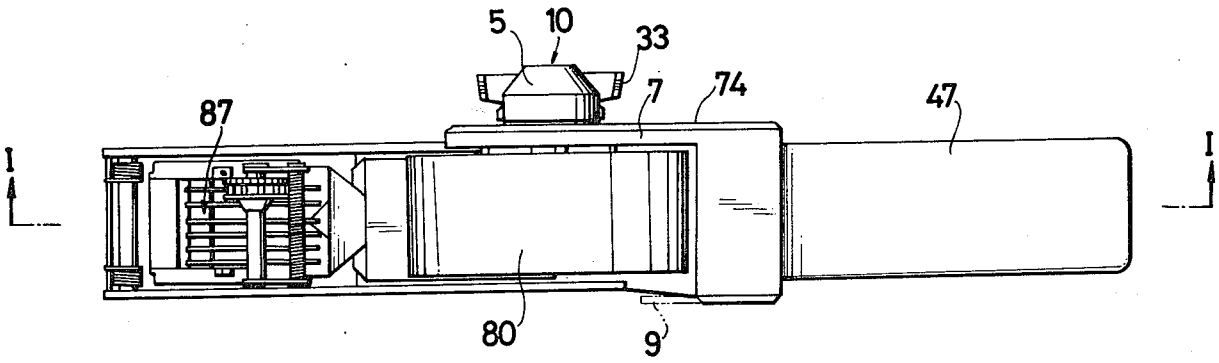
FIG. 2 is a plan view of the labeling machine of FIG. 1.

The two-dot chain lines 9 in FIGS. 1 and 2 is an unrolling preventing plate for preventing the rolled label strip 80 that is attached to the supporting device 10 from undesired unrolling that might occur during the use of the label printing and applying machine.

After the rolled label strip 80 is exhausted, the core 6 is detached from the machine. To detach the core 6, the disengaging pinch pieces 33 are pinched and this pivots the fastening sections 31 toward each other about the fulcrum pins 42, against the force of the fastening spring 41. As shown in FIGS. 6(*a*) and 7(*a*), the engagement between the inner shorter sides 16 of the opening 12 of the pushing member 1 and the attaching grooves 37 of the fastening sections 31 is released. The whole body of the pushing member 1 is propelled toward the core 6 by the pushing springs 4. Thus, the corners 18 in the front portion (left ends in FIG. 7(*a*) of the inner shorter sides 16 of the opening 12 are brought into contact with and are stopped by the bearing surfaces 44 of the disengaging steps 36 in the fastening sections 31.

The engagement between the fitting surface 65 in the core 6 and the fitting surfaces 30 of the slip heads 34 is released and, as described above, the pushing member 1 is abruptly moved by the springs 4. The pushing faces 14 of the pushing lugs 13 and 13' repel the raised surfaces 67 of the core 6, and the core 6 may be disengaged from the supporting device 10 without even touching the core 6 with the hand.

The pinching movement of the fastening members 3 is stopped when the bases of the pinch pieces 33 are brought into contact with the stopper surfaces 56 on the inside of the top or rear face 53 of the rear cover 5.

In the above-disclosed first embodiment, the pushing springs 4 and the fastening spring 41 are both coil springs. However, any elastic or biasing means may be employed so long as they have the corresponding effect.

Further, in the first embodiment, the core 6 has four each of recesses 66 for preventing idle rotation, raised surfaces 67 and recesses 68. However, the number of each of these is not necessarily restricted to four. In this case, the raised surfaces 67 correspond in their positions to the pushing faces 14 of the pushing member 1.

Still further, a pair of fastening members 3 are used. However, the number of the fastening members 3 is not restricted to two, so long as the fastening sections 31 of the members 3 can be smoothly engaged with the cooperating portions of the pushing member 1 and the core 6.

Also, the supporting device 10 is shown as attached to the side arm plate 7 which is formed on the upper extension of the casing of a label printing and applying machine. However, the attachment of the supporting device is not restricted to such manner. For example, it can be attached to a gun-shaped label printing and applying machine having the supporting device within the casing thereof or to an appropriate location in any other labeling machine.

The second embodiment of the present invention is now described with reference to FIGS. 8 to 14. Elements corresponding to those in the first embodiment of the supporting device are correspondingly numbered, with reference numerals that are raised by 100. Other features not directly included in the supporting device retain the same numerals.

The supporting device 110 of the second embodiment of the present invention comprises a pushing member 101, a main body 102, fastening members 103, pushing springs 104, a rear cover 105, a fastening member spring 141, front covers 108, a push button and a push button return spring 189. These structures are now detailed.

The pushing body 101 is located inside the supporting device 110 at the front side of device 110 toward the core 106 of a rolled label strip. There are three fan or crescent shaped supporting plates 140 of the pushing member 101. These are separated from each other to define a Y-shaped opening 112. There are three pushing lugs 113, which are formed at the end portions of the legs of the opening 112 and which are integrally attached to the supporting plates 140.

Figure 14B:
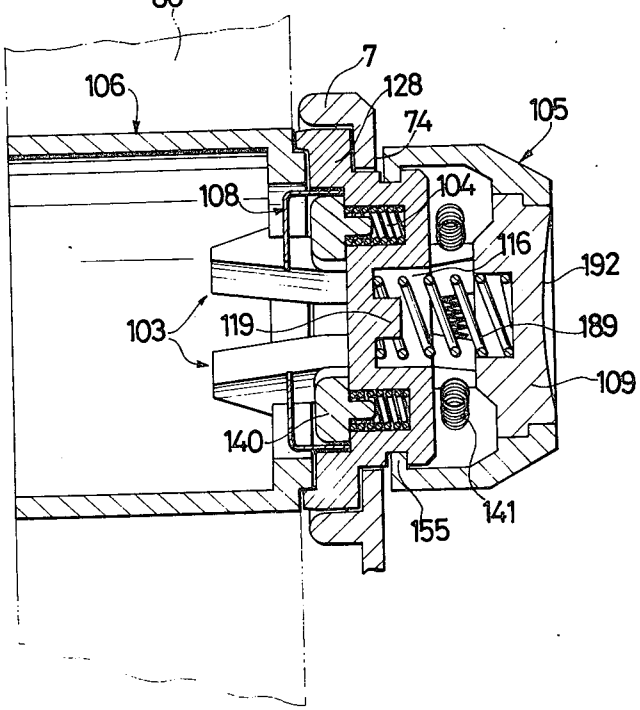
FIGS. 14(*a*) and 14(*b*) are cross-sectional views along the line XIV—XIV in FIG. 8, in which FIG. 14(*a*) shows the condition before the core is attached to the supporting device and FIG. 14(*b*) shows the condition after the core is attached.
Figure 14A:
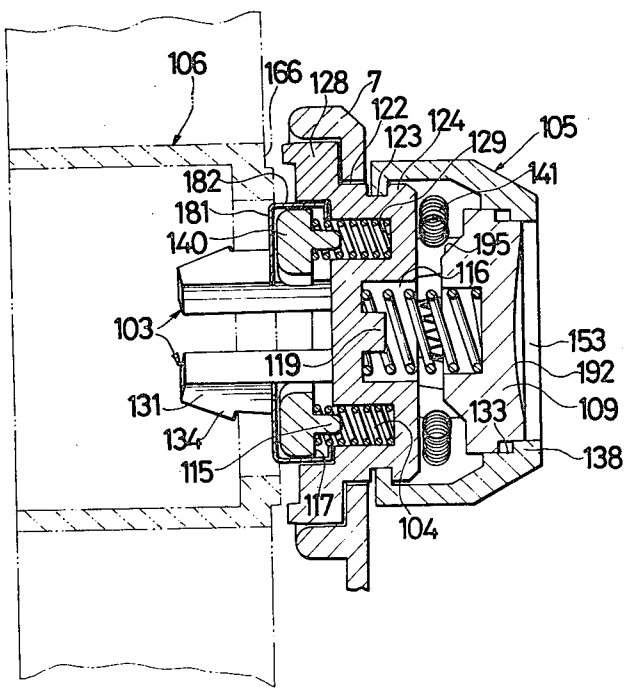

The pushing lugs 113 have outer arcuately shaped rims which are all arrayed along the same circumference. The free edges of the rims are bent at right angles to the lugs and forward toward the core 106. At their forward edges, the lug rims form the respective core pushing faces 114. As shown in FIGS. 14(*a*) and 14(*b*), projections 115 for receiving the pushing springs 104 are formed on the rear surfaces 117 of the supporting plates 140 and opposite to the pushing faces 114.

The main body 102 integrally carries, in sequence moving away from core 106, a collar 121 having the same outer diameter as the exterior of pushing lugs 113 of pushing member 101, a circular stepped portion 122 having a smaller diameter, a circular groove 123 having a still smaller diameter than that of step 122, and a rim 124 having a larger diameter than that of circular groove 123. Three rectangularly shaped fastening member attachment holes 127 are formed in the middle portion of the main body 102 away from rim 124 at equally spaced intervals around the body 102 and they extend through the body 102 parallel to the axis of body 102.

At three equally spaced sections around the collar 121 on its side near the core 106, there are three fan or crescent shaped, forwardly projecting guide members 128. The guide members 128 project into the recesses 166 in core 106. The two radially extending surfaces on both circumferential sides of each guide member 128 form guide surfaces 150, which define openings of the width of each lug 113. The side surfaces 149 of pushing lugs 113 of pushing member 101 are closely fitted to and guided by the guide surfaces 150.

Blind holes 129 are formed in the surface of main body 102 that faces toward the bottom surface 117 of pushing body 101. The positions of the blind holes 129 coincide with the supporting projections 115 for receiving the pushing springs 104 between them. Thus, when the pushing member 101 and the main body 102 are assembled together, each pushing spring 104 is received by a respective supporting projection 115 and by a blind hole 129. In the center of the surface of the pushing body 101 that is opposite to the surface 125 of main body 102, there is a recess 116. The bottom surface of the recess 116 has a supporting projection 119 for supporting a push button spring 189.

Further, there are fulcrum pin receiving holes 126 which extend through the portions of main body 102 between the attachment holes 127 and the circular groove 123 around body 102. As shown in part in FIG. 12, there are six holes 126, two for each hole 127 which extend from the inside side surfaces of the attachment holes 127 toward the circular groove 123.

One end portion of every fastening member 103 defines a fastening section 131. At the other end portion of every fastening member 103, an exterior engaging groove 132 is formed for receiving the common fastening spring 141. The exterior side of the fastening section 131 is stepped and it includes a tapered slip head 134, a fastening step 135 behind head 134, a disengaging step 136 behind the step 135 and an elongated attaching step 137 behind step 136. Each succeeding step is lower in height. Fulcrum pin holes 139 are formed in the side faces of fastening members 103. Holes 139 have almost the same diameter as fulcrum pin holes 126.

The rear cover 105 is comprised of a cylindrical front portion 151 which is divided into three equal size, equally spaced sections, a frustoconical portion 152 behind portion 151 and a round opening 153 at the top or rear. The three sections of the cylindrical portion 151 are shaped to define openings 154 between these sections. The forward edge of the cylindrical portion 151 is bent radially inwardly at right angles to form rims 155. The inner rim at the top or rear end of the frustoconical portion 152 forms a circular, radially inwardly extending projection 138. A guiding portion 133, having an inner diameter larger than that of the circular projection 138, is formed beneath the circular projection 138.

The push button 109 includes an integral circular rim 191 around the periphery of the button, a pressing surface 192 on the top or rear side of the button and a blind hole 193 extending in from the bottom or front side 196. The middle portion of the rear pressing surface 192 is slightly depressed. Between the pressing surface 192 and the circular rim 191 is an engaging surface 194 which is in engagement with the circular projection 138 of the rear cover 105. Further, an inclined surface 195 is formed between the bottom surface 196 of the button and the circular rim 191.

Three front covers 108 extend over and are correspondingly shaped to the respective supporting plates 140 of pushing member 101. Each front cover 108 integrally comprises a fan shaped front plate 181, a circumferential, rearwardly extending side plate 182 bent rearwardly from the outer rounded edge of the front plate 181 and a rear plate 183 bent inwardly from the side plate 182 and opposed to the front plate 181. At both end arcuate portions of the side plates 182 and the rear plates 183 of front covers 108, cutaway portions 185 are formed. These extend from halfway along the width of the side plates 182 rearwardly to the level of the rear plates 183. The axial width of side plates 182 is greater than the thickness of supporting plates 140 of the pushing member 101 to provide clearance to allow the pushing member 101 to move within the space between the respective front plates 181 and the rear plates 183.

The above disclosed parts are assembled in the manner shown in FIGS. 10, 11, 13 and 14. The assembly is attached to the side arm plate 7 formed on the upper wall of a label printing machine. During assembly, the front covers 108 are oriented to be between the neighboring pushing lugs 113 of the pushing member 101 and to be outside and in front of the supporting plates 140. The inner arcuately curved surfaces of side plates 182 are in contact with the curved peripheral surfaces of the supporting plates 140 of pushing member 101.

Then the pushing member 101 carrying the front covers 108 is assembled together with the main body 102 in such manner that the side faces 149 of the three pushing lugs 113 are fitted into the three spaces formed between the opposed guide surfaces 150 of the guide members 128 of the main body 102. The rear plates 183 of the front covers 108 are thereby brought into contact with the surface 125 of main body 102.

The pushing springs 104 have previously been inserted between the blind holes 129 and the supporting projections 115.

Figure 12:
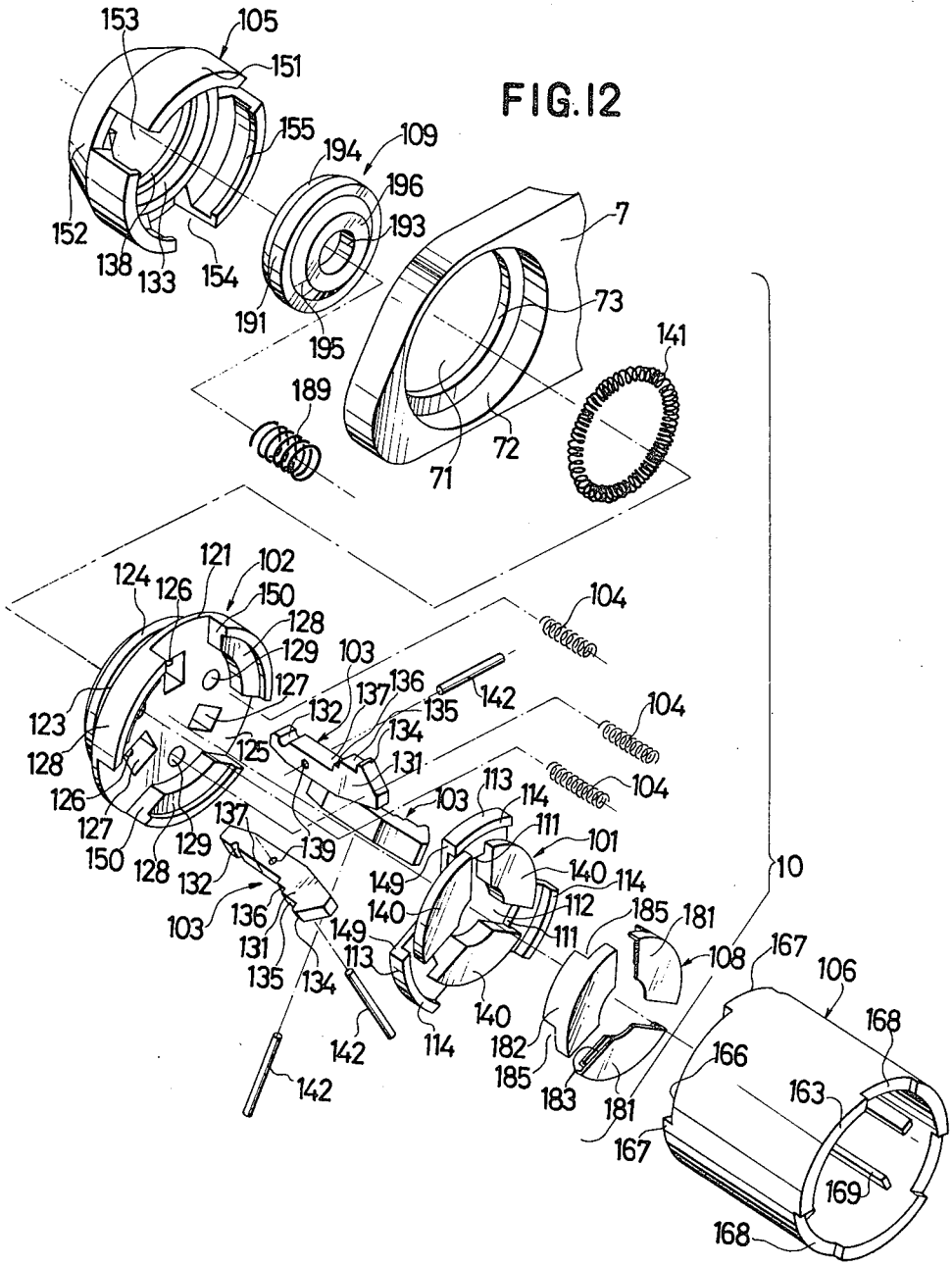
FIG. 12 is an exploded perspective assembly view of the first embodiment of the supporting device and the core.

This assembly is fitted into the rotation hole 71 of the side arm plate 7 from the front side (the right side in FIG. 12). The rotation hole 71 was described in connection with the first embodiment. The stepped portion 122 of the main body 102 is fitted into the smaller diameter portion 73 of the hole 71. The collar 121 and the guide members 128 of the main body 102 and the pushing lugs 113 of the pushing body 101 are fitted into the larger diameter portion 72 of hole 71 such that rotation of the supporting member 110 is permitted with proper frictional resistance as the label strip 70 is pulled.

Figure 13B:
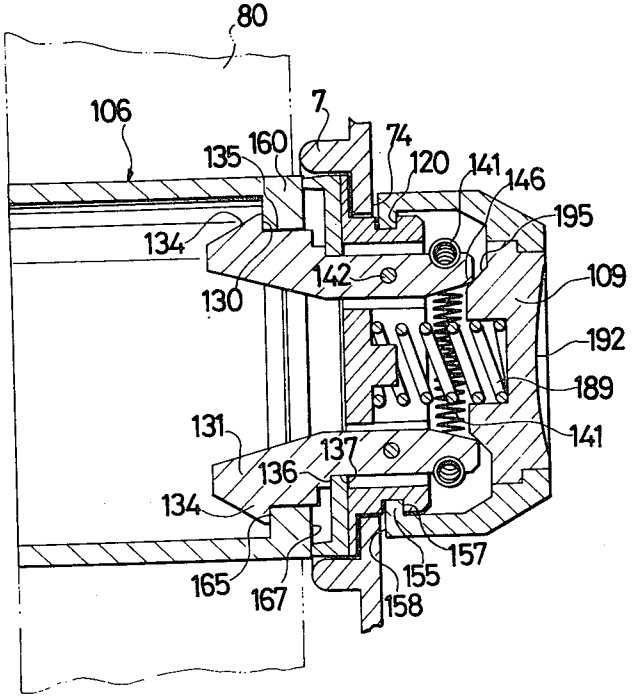
FIGS. 13(*a*) and 13(*b*) are cross-sectional views taken along the line XIII—XIII in FIG. 8, in which FIG. 13(*a*) shows the condition before the core is attached to the supporting device and FIG. 13(*b*) shows the condition after the core is attached.
Figure 13A:
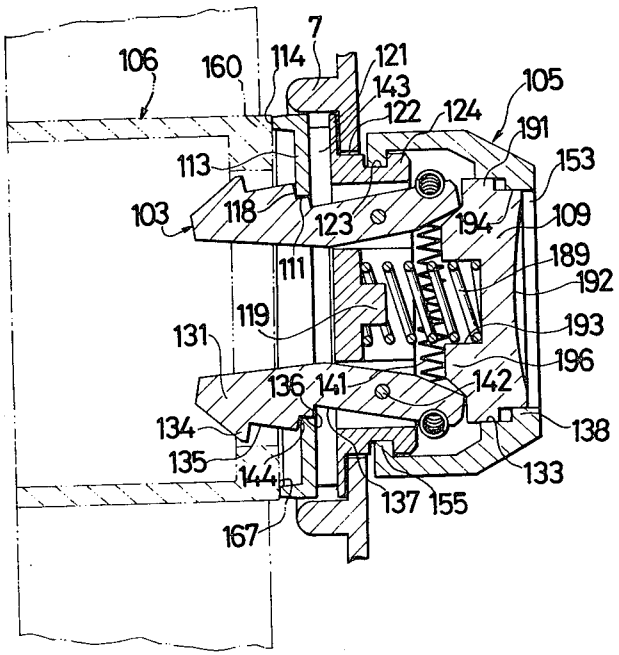

Next, the rear ends of the fastening sections 131 of fastening members 103 are inserted into the rearwardly extending attachment holes 127 of the main body 102. The front ends of the fastening sections 131 are inserted forward through the opening 112 of the pushing member 101. As shown in FIG. 13(*a*), the disengaging steps 136 of the fastening sections 131 are brought into engagement with the inside edge walls 111 which define the opening 112 in the pushing member 101.

Further, each pair of fulcrum pin holes 126 formed in the circular groove 123 and passing through a respective attachment hole 127 of the main body 102 and the fulcrum pin hole 139 through the corresponding fastening member 103 are aligned. The fastening members 103 are correctly pivotally positioned by inserting the fulcrum pins 142 into the aligned holes.

When the fastening members 103 are secured by the pins 142, the fastening spring 141 is positioned to encircle the fastening members 103 and is fitted into the engaging grooves 132 formed on the outside of the fastening members 103, thereby urging the front fastening sections 131 to pivot outwardly around their respective fulcrum pins 142.

The push button 109 is inserted into the round opening 153 in the rear cover 105. The rear peripheral engaging surface 194 of push button 109 is fitted against the inside surface of the circular projection 138 and the more forward circular rim 191 of button 109 is fitted to the inside guide surface 133 in the cover 105. The rear cover 105 with the button 109 in place is then applied on the rear side of the main body 102 over the circular rim 124. The rims 155 of rear cover 105 engage in the circular groove 123 around main body 102. During the emplacement of the cover 105, the pressing spring 189 is placed in the blind hole 193 on the rear side of the push button 109 and on the supporting projection 119 of the main body 102. Furthermore, as shown in FIG. 13(*b*), the rearwardly facing, rearward fitting surfaces 157 of the rims 155 are brought into contact with the forwardly facing fitting surface 120 of the circular groove 123 with some pressure. However, a slight clearance is left between the forwardly facing forward surfaces 158 of the rims 155 and the outer surface 74 of the side arm plate 7 so as to allow the rotation of the supporting device 110.

The supporting device 110 carries a core 106 which has a rolled label strip 70 wound around it. As will be understood from FIGS. 10–12, the core 106 has three equally spaced apart raised surfaces 167 at its rear end. These are separated by three large fan or crescent shaped recesses 166 which are around the outer periphery of rear face 164 of core 106. There are also three recesses 168 at the front end of the core which are shaped and spaced so as to be matable with the raised surfaces 167. The above described structure of the core 106 is selected because the pushing member 101 has three pushing faces 114. Other features of the core 106 are the same as those of the core 6 of the first embodiment.

As shown in FIGS. 13(*a*) and 14(*a*), when the core 106 is attached to the supporting device 110, the three raised surfaces 167 of the fastening portion 160 of core 106 are respectively brought into contact with the corresponding three core pushing faces 114 of the pushing member 101 in the supporting device 110, and the core 106 is then pushed toward the side arm plate 7. The guide members 128 on the main body 102 are received in the recesses 166, which are correspondingly sized and shaped, to prevent relative rotation between the body 102 and the core 106. The pushing member 101 is moved toward the main body 102 pressing the pushing springs 104 and reducing the gap 143 that is caused by the force of the springs 104.

As shown in FIG. 13(*a*) before the pushing with the core 106, the right end (as viewed in the drawing) of disengaging step 136 and the right end of the inner edge 111 of pushing lug 113 are in contact with each other, and the bearing surface 144 of the disengaging step 136 and the left corner 118 of the inner edge 111 are also in contact with each other. Thus, the pushing member 101 is supported by the fastening members 103. After the pushing with the core 106, as shown in FIGS. 13(*b*) and 14(*b*), the above engagement is released and the fastening sections 131 of the fastening members 103 are pivoted slightly apart around the fulcrum pins 142 by the force of the fastening member spring 141. The inner edges 111 of the pushing lugs 113 are received on the attaching steps 137 of the fastening members 103. The separation between the fastening steps 135 of fastening members 103 is enlarged. As a result, the internal fitting surface 165 in the bore 162 of core 106 is caught by the fitting surfaces 130 of the slip heads 134 of members 103. In addition, the pushing surfaces 114 press against the raised surfaces 167 of the core 106. The core 106 is thereby firmly and reliably supported.

Further, because the supporting plates 140 of the pushing member 101 are covered by the front covers 108, enlargement of the space between the fastening sections 131 of the fastening members 103 due to careless pushing of the supporting plates 140 when the core 106 is not attached can be prevented. Such pushing would make the attachment of core 106 difficult.

Figure 8:
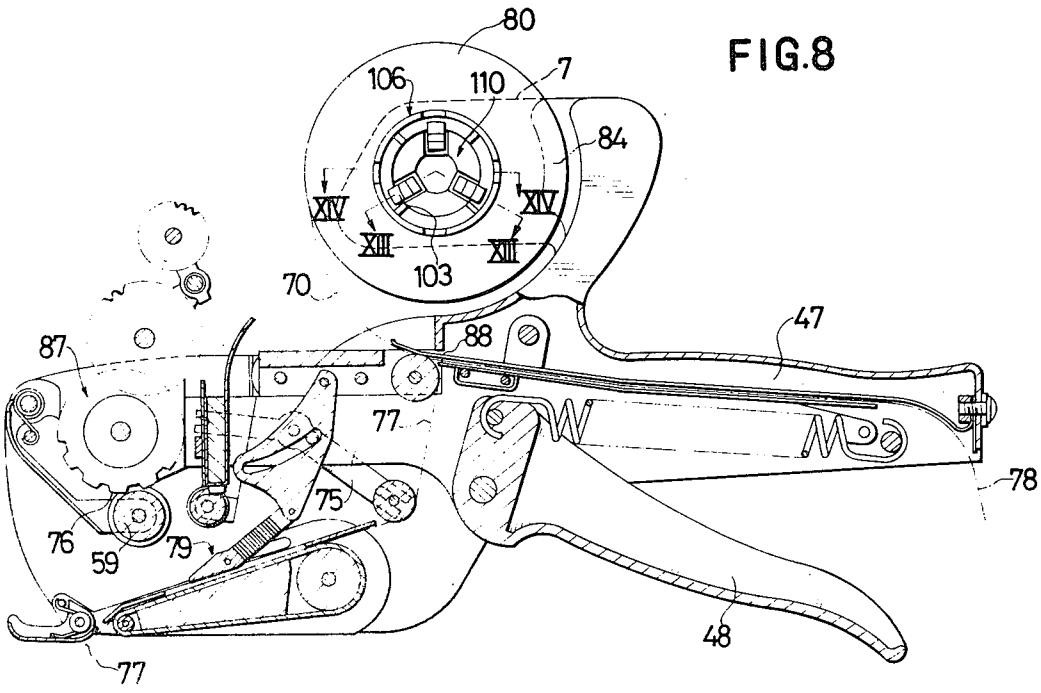
FIG. 8 is a vertical cross-sectional view of a label printing and applying machine which has been provided with a second embodiment of the supporting device of the present invention, viewed along the line of and in the direction of arrows VIII—VIII in FIG. 9.
Figure 9:
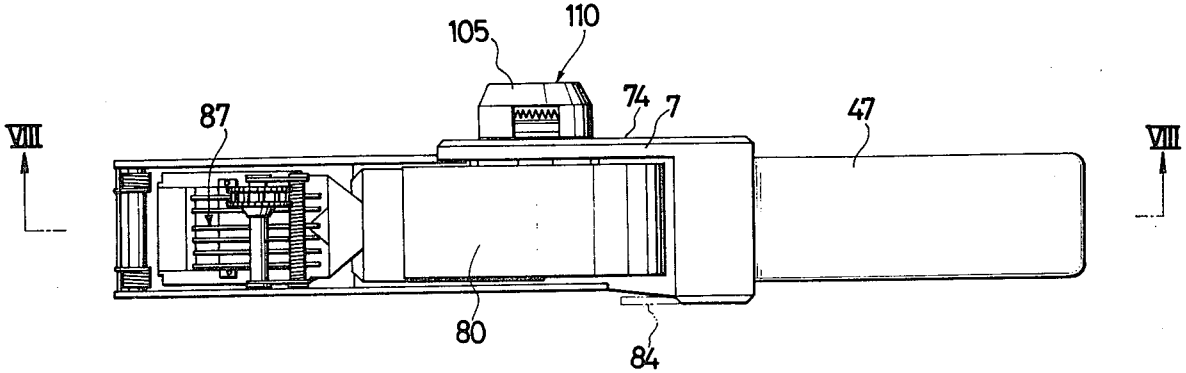
FIG. 9 is a top plan view of the labeling machine of FIG. 8.
Figure 11:
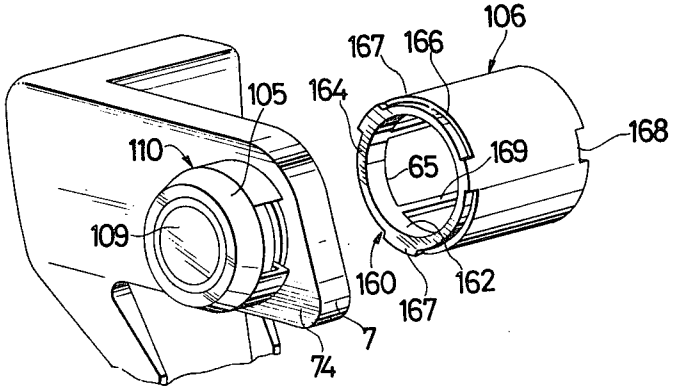
FIG. 11 is the opposite perspective view of the supporting device of the second embodiment of the present invention, as viewed from the direction opposite to FIG. 10.
Figure 10:
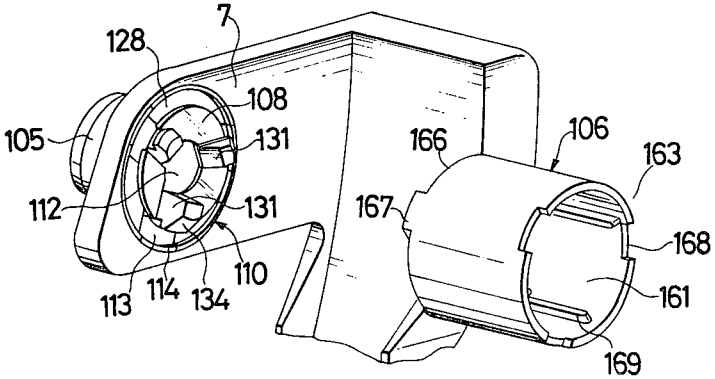
FIG. 10 is one perspective view of the second embodiment of the supporting device of the present invention, as a core is about to be attached to a labeling machine and of a core.

Once the core is supported as described, the printing and applying of labels from the strip can be performed by operating the label printing machine in like manner as with the first embodiment. In FIGS. 8 and 9, the same parts as those of the first embodiment in FIGS. 1 and 2, are represented with the same numerals. The label strip unrolling preventing plate 84 is similar to the plate 9 in the first embodiment.

When the rolled label strip 80 is used up through the operation of label printing machine, the core 106 is detached from the machine. This involves depressing the pressing surface 192 of the push button 109 with a finger. The inclined surface 195 of the push button 109 pushes on the rear corners 146 of fastening members 103 which biases the rear corners 146 apart. The space between the rear ends of fastening members 103 is enlarged against the biasing force of the fastening member spring 141. Accordingly, the fastening sections 131 pivot around the fulcrum pins 142 and approach each other against the force of the fastening member spring 141. As shown in FIGS. 13(*a*) and 14(*a*), the engagement between the inner edges 111 of the pushing lugs 113 of pushing member 101 and the attaching steps 137 of the fastening sections 131, is released. The whole body of the pushing member 101 is repelled toward the core 106 by the pushing force of springs 104. Thus the corners 118 in the front portions (left ends in FIG. 13(*a*) of the inner edges 111 of the pushing lugs 113 contact and are stopped by the bearing surfaces 144 of the disengaging step 136 in the fastening sections 131.

In this operation, the engagement between the fitting surface 165 in the fitting portion 160 of the core 106 and the fitting surfaces 130 of the slip heads 134 is also released. The abrupt movement of the pushing member 101 under the influence of the springs 104 causes the pushing faces 114 of the pushing lugs 113 to repel the raised surfaces 167 of the core 106. The core 106 may be disengaged from the supporting device 110 without having to touch the core 106.

The supporting devices of both preferred embodiments of the present invention for supporting a rolled label strip are quite different from the conventional supports which use flexible supporting tabs to hold the cores therebetween. Here a core is carried by the fastening sections of pivotally movable fastening members and the force of springs engages and releases the cores. The following features and practical advantages may be expected.

(1) Attachment of a core 6, 106 is easily carried out because it is only necessary to press the raised surfaces 67, 167 of the core 6, 106 against the pushing faces 14, 114 of the supporting device and to push upon the core 6. Neither strong force nor special skill is required.

(2) Disengagement of the core involves operating a simple disengaging means, such as pinch pieces 33 or a push button 109 formed on the outside of the side arm plate 7. The core is then pushed out by the force of pushing springs 4, 104.

(3) It is not necessary to either turn or pull the core 6, 106 to disengage it, which is different from the conventional methods. Thus, the fastening members 3, 103 are not subjected to any excessive force. In addition, damage to parts can be largely reduced.

(4) The attachment of the core does not depend upon the flexibility of supporting tabs. Thus, unexpected disengagement of the core due to the deterioration of flexibility does not occur during the operation of the machine, and the core having a rolled label strip can be always held reliably.

Therefore, it will be understood that the supporting device of the present invention for supporting the core of rolled label strip is advantageous as compared with the conventional devices.

Although the present invention has been described in connection with preferred embodiments thereof, many variations and modifications will now become apparent to those skilled in the art. It is preferred, therefore, that the present invention be limited not by the specific disclosure herein, but only by the appended claims.

I claim:

1. A supporting device for supporting a rolled strip, comprising:

a main body having a first side facing toward a rolled strip, comprising:

a main body having a first side facing toward a rolled strip pushing member;

a rolled strip pushing member having a second side facing toward said body first side and having a third side facing toward a rolled strip to be supported;

first biasing means engaging said pushing member for normally urging said third side thereof toward a rolled strip;

a rolled strip fastening member supported on said body; said fastening member including a fastening section extending to a rolled strip; said fastening section being movable with respect to said body to be engaged with and to be disengaged from the rolled strip; said fastening section engaging the rolled strip for holding same against said pushing member with said first biasing means charged ready to move said pushing member;

disengaging means connected to said rolled strip fastening member for moving said fastening member to disengage said fastening section from the rolled strip, thereby releasing the rolled strip to be moved by said pushing member under the urging of said first biasing means.

2. The supporting device of claim 1, wherein there are a plurality of said fastening members all operable together to engage with and disengage from the rolled strip and there are said disengaging means for all said fastening members.

3. The supporting device of claim 1, wherein said first biasing means is connected between said first and said second sides and is charged as those said sides move together.

4. The supporting device of claim 1, wherein said fastening member is pivotally attached to said body to move its said fastening section to engage with and to disengage from the rolled strip.

5. The supporting device of claim 4, wherein there are a plurality of said fastening members all operable together to engage with and disengage from the rolled strip and there are said disengaging means for all said fastening members.

6. The supporting device of claim 5, wherein said pushing member is divided into a plurality of pushing lugs, separated from each other around said pushing member; each said lug having a rolled strip pushing face at said third side of said pushing member.

7. The supporting device of claim 6, wherein said main body has a plurality of guide members at said first side thereof and spaced apart to receive said pushing lugs between them and said pushing lugs being received between said guide members of said main body as said first and said second sides are moved together and apart, thereby to guide motion of said lugs toward and away from said main body.

8. The supporting device of claim 6, further comprising front covers, one for each said pushing lug, on said third side of said pushing member and covering over said third side of said pushing member but exposing said rolled strip pushing faces of said lug;

said front covers having side walls thereof extending along the path of motion of said pushing member and said side walls being of a width greater than the thickness of said pushing member, thereby to allow said pushing member to shift as said front cover stays still with respect to said pushing member.

9. The supporting device of claim 5, wherein said second biasing means joins said fastening members together and jointly biases all said fastening members to move together.

10. The supporting device of claim 9, wherein said disengaging means for said fastening members comprise a respective pinch piece on the end of each said fastening member away from said fastening section thereof, and pinchable to move said fastening members to disengage from the rolled strip.

11. The supporting device of claim 9, wherein said disengaging means comprise a pushable button engageable with the ends of said fastening members away from said fastening sections thereof, and said pushable button being shaped and placed such that when said button is pushed, it shifts said fastening sections off connection to the rolled strip.

12. The supporting device of claim 5, in which the rolled strip is on a hollow core; said supporting device further comprising said fastening section being of a length to extend to the hollow of the core; said second biasing means normally urging said fastening sections of said fastening members to pivot outwardly to engage a fitting section of the core at the interior thereof.

13. The supporting device of claim 12, further comprising an opening through said pushing member and being defined by a peripheral wall defined in said pushing member; said opening being shaped and positioned such that said fastening members extend therethrough and said fastening members all being movable between their positions while in said pushing member opening.

14. The supporting device of claim 13, wherein said fastening sections all have an outwardly facing side and on said outwardly facing side, moving along said fastening members away from the rolled strip to be engaged thereby, said fastening members having: a fastening step shaped and positioned to be engageable with a fitting portion of the rolled strip;

a disengaging step to be engaged by said periphery of said opening in said pushing member when said fastening step is outside the rolled strip and is moving to engage with and disengage from the fitting portion of the rolled strip; and an attaching step which is also shaped and positioned to engage said periphery around said opening in said pushing member after said fastening step has engaged the fitting portion of the rolled strip and after said pushing member has been urged toward said main body by the engagement of said pushing member with the rolled strip.

15. The supporting device of claim 14, wherein said disengaging step is shorter in height on said outwardly facing side of said fastening section than said fastening step and taller in height than said attaching step.

16. The supporting device of claim 15, wherein said outwardly facing side has at the part thereof nearer to the rolled strip than said fastening step, a slip head shaped to be guided past said periphery around said opening in said pushing member, and said slip head being taller than said fastening step.

17. The supporting device of claim 16, wherein a first wall facing away from the rolled strip is defined between said slip head and said fastening step and a second wall also facing away from the rolled strip is defined between said fastening step and said disengaging step.

18. The supporting device of claim 12, wherein said pushing member is divided into a plurality of pushing lugs, separated from each other around said pushing member; each said lug having a rolled strip pushing face at said third side of said pushing member.

19. The supporting device of claim 12, further comprising a front cover on said third side of said pushing member and between said pushing member and said core;

said front cover having side walls thereof extending along the path of motion of said pushing member and said side walls being of a width greater than the thickness of said pushing member, thereby to allow said pushing member to shift as said front cover stays still with respect to said pushing member.

20. The supporting device of claim 12, wherein said pushing member is divided into a plurality of pushing lugs, separated from each other around said pushing member; each said lug having a rolled strip pushing face at said third side of said pushing member;

said pushing lugs having core engaging projections on said core facing third side thereof;

the core having core projection receiving recesses thereon engageable with said core engaging projections upon the core being mounted to said fastening sections.

21. The supporting device of claim 5, wherein said main body has a respective attachment hole defined therein for receiving each said fastening member; said fastening members passing through said attachment holes therefor;

fastening member pivot mounting means in each said attachment hole for pivotally mounting each said fastening member to said main body.

22. The supporting device of claim 5, wherein said main body has an attachment hole means defined therein for receiving said fastening members; said fastening members passing through said attachment hole means therefor;

fastening member pivot mounting means in said attachment hole means for pivotally mounting said fastening members to said main body.

23. The supporting device of claim 22, further comprising an opening through said pushing member and being defined by a peripheral wall defined in said pushing member; said opening being shaped and positioned such that said fastening members extend therethrough and said fastening members all being movable between their positions while in said pushing member opening.

24. The supporting device of claim 23, wherein said fastening sections all have an outwardly facing side thereof and on said outwardly facing side, moving along said fastening members away from the rolled strip to be engaged thereby, said fastening members having: a fastening step shaped and positioned to be engageable with a fitting portion of the rolled strip;

a disengaging step to be engaged by said periphery of said opening in said pushing member when said fastening step is outside the rolled strip and is moving to engage with and disengage from the fitting portion of the rolled strip; and an attaching step which is also shaped and positioned to engage said periphery around said opening in said pushing member after said fastening step has engaged the fitting portion of the rolled strip and after said pushing member has been urged toward said main body by the engagement of said pushing member with the rolled strip.

25. The supporting device of claim 24, wherein said pushing member is divided into a plurality of pushing lugs, separated from each other around said pushing member; each said lug having a rolled strip pushing face at said third side of said pushing member.

26. The supporting device of claim 25, wherein said disengaging step is shorter in height on said outwardly facing side of said fastening section than said fastening step and taller in height than said attaching step.

27. The supporting device of claim 26, wherein said outwardly facing side has at the part thereof nearer to the rolled strip than said fastening step a slip head shaped to be guided past said periphery around said opening in said pushing member and said slip head being taller than said fastening step.

28. The supporting device of claim 27, wherein a first wall facing away from the rolled strip is defined between said slip head and said fastening step and a second wall also facing away from the rolled strip is defined between said fastening step and said disengaging step.

29. The supporting device of claim 28, wherein said main body has a plurality of guide members at said first side thereof and spaced apart to receive said pushing lugs between them and said pushing lugs being received between said guide members of said main body as said first and said second sides are moved together and apart, thereby to guide motion of said lugs toward and away from said main body.

30. The supporting device of claim 29, wherein said disengaging means for said fastening members comprise a respective pinch piece on the end of each said fastening member away from said fastening sections thereof, and pinchable to move said fastening members to disengage from the rolled strip.

31. The supporting device of claim 30, wherein each said fastening member is of generally L-shape, with said pinch pieces being at the end of one arm of the L thereof; said pinch piece arms intersecting each other;

said second biasing means being connected between said fastening members to bias said fastening sections thereof apart.

32. The supporting device of claim 30, further comprising a rear cover at the other side of said main body from said pushing member; cooperating means in said rear cover and on said main body for engaging said main body;

said fastening members extending past said rear cover and said rear cover having stopper faces for being engaged by said fastening members passing thereby for preventing idle turning of said fastening members with respect to said rear cover.

33. The supporting device of claim 24, wherein said disengaging means comprise a pushable button engageable with the ends of said fastening members away from said fastening sections thereof, and said pushable button being shaped and placed such that when said button is pushed, it shifts said fastening sections off connection to the rolled strip.

34. The supporting device of claim 33, wherein said second biasing means engages said fastening members to bias same in opposition to motion thereof resulting from pushing of said button.

35. The supporting device of claim 34, further comprising a rear cover at the other side of said main body from said pushing member; cooperating means in said rear cover and on said main body for engaging said main body;

an opening into said rear cover away from said fastening members and into which said button is slidably fitted for moving as it is pushed;

said fitting members having an engagement surface; said button having a cooperating engagement surface and said engagement surfaces being so shaped that as they engage, said button forces said fastening members to pivot apart and said fastening sections thereof to pivot together.

36. The supporting device of claim 35, further comprising third biasing means engaging said button for normally biasing said button away from said main body.

37. The supporting device of claim 1, further comprising:

second biasing means for normally urging said fastening section to move to engage a rolled strip emplaced to be engaged by said fastening section.

* * * * *